United States Patent [19]

Hama et al.

[11] Patent Number: 4,731,353

[45] Date of Patent: Mar. 15, 1988

[54] HEAT-SENSITIVE RECORDING MATERIAL

[75] Inventors: Fumio Hama, Osaka; Nobuo Kanda, Hirakata; Mitsuru Kondo, Hyogo, all of Japan

[73] Assignee: Kanzaki Paper Manufacturing Company, Limited, Tokyo, Japan

[21] Appl. No.: 13,781

[22] Filed: Feb. 12, 1987

[30] Foreign Application Priority Data

Feb. 24, 1986 [JP] Japan ..... 61-38816

[51] Int. Cl.[4] ..... B41M 5/18

[52] U.S. Cl. ..... 503/210; 427/151; 503/211; 503/212; 503/216; 503/225

[58] Field of Search ..... 427/150–152; 503/210–212, 216, 217, 225

[56] References Cited

U.S. PATENT DOCUMENTS

| | | | |
|---|---|---|---|
| 4,234,212 | 11/1980 | Kato et al. | 503/216 |
| 4,303,719 | 12/1981 | Vassiliades | 503/216 |
| 4,403,791 | 9/1983 | Schmidt et al. | 427/151 |
| 4,590,500 | 5/1986 | Satake et al. | 503/216 |

FOREIGN PATENT DOCUMENTS

| | | | |
|---|---|---|---|
| 0025989 | 2/1983 | Japan | 503/225 |
| 0185483 | 8/1986 | Japan | 503/216 |

*Primary Examiner*—Bruce H. Hess
*Attorney, Agent, or Firm*—Larson and Taylor

[57] ABSTRACT

Disclosed is a heat-sensitive recording material comprising a base sheet and a heat-sensitive record layer formed over the base sheet and comprising a colorless or pale-colored basic dye and a color developing material capable of forming a color when contacted with the dye, the heat-sensitive recording material being characterized in that the heat-sensitive record layer contains as the color developing material at least one multi-valent metal salt of an indole-2-carboxylic acid derivative represented by the formula

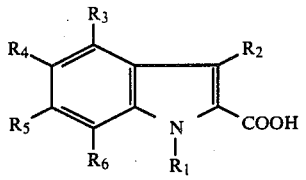

(I)

wherein $R_1$ through $R_6$ are hydrogen or other substituent. The heat-sensitive recording material is resistant to plasticizer and diazo developer, and also is suitable for high-speed recording.

6 Claims, No Drawings

HEAT-SENSITIVE RECORDING MATERIAL

This invention relates to heat-sensitive recording materials, and more particularly to heat-sensitive recording materials which are outstanding in high-speed recording and in colorfastness and having an unrecorded portion (background portion) less susceptible to the reduction of whiteness, and which therefore can maintain the record image with stability.

Heat-sensitive recording materials are well known which are adapted to produce record images by thermally contacting a colorless or pale-colored basic dye with an organic or inorganic color developing material.

With recent remarkable progress in thermal recording systems, high-speed recording systems have become available. For example, thermal facsimile systems produce a copy of A4 size within 20 seconds, and thermal printers achieve a recording speed of at least 120 characters per second. For use with such high-speed recording systems, there is a demand for heat-sensitive recording materials suitable for use in high-speed recording.

On the other hand, these heat-sensitive recording materials are being used in various manners with the rapidly increasing use of thermal facsimiles, thermal printers and the like, and thus are more frequently stored as contacted with plastics film or as laid over other record media such as diazo copying paper (diazotype paper).

However, when a heat-sensitive recording material suited to high-speed recording is stored in contact with plastics film, the record image is markedly prone to fade. When the heat-sensitive recording material is stored in contact with diazo copying paper, particularly such paper subjected to copying operation immediately before contact, the white background portion of the recording material significantly tends to undergo the coloring (fogging) due to the action of the diazo developer and lose its whiteness. At present, it is strongly desired to remedy the foregoing drawbacks of the heat-sensitive recording materials for high-speed recording.

An object of the present invention is to provide heat-sensitive recording materials satisfactorily suitable for high-speed recording.

Another object of the invention is to provide heat-sensitive recording materials which, even stored in contact with plastics film, can retain the record image without marked fading.

Another object of the invention is to provide heat-sensitive recording materials which, even in contact with a diazo developer on the diazo copying paper, are not subject to the fogging of the background portion.

These objects and other features of the present invention will become more apparent from the following description.

This invention provides heat-sensitive recording materials comprising a base sheet and a heat-sensitive record layer formed over the base sheet and comprising a colorless or pale-colored basic dye and a color developing material capable of forming a color when contacted with the dye, the heat-sensitive recording material being characterized in that the heat-sensitive record layer contains as the color developing material at least one multi-valent metal salt of an indole-2-carboxylic acid derivative represented by the formula

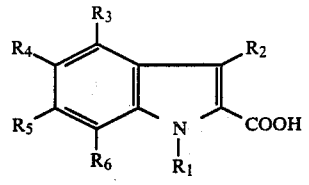

(I)

wherein $R_1$ is hydrogen atom, substituted or unsubstituted alkyl group, substituted or unsubstituted cycloalkyl group, substituted or unsubstituted alkenyl group, substituted or unsubstituted alkynyl group, substituted or unsubstituted aryl group, substituted or unsubstituted aralkyl group, substituted or unsubstituted alkylcarbonyl group or substituted or unsubstituted arylcarbonyl group; and $R_2$ through $R_6$ each represent hydrogen atom, substituted or unsubstituted alkyl group, substituted or unsubstituted cycloalkyl group, substituted or unsubstituted alkenyl group, substituted or unsubstituted alkynyl group, substituted or unsubstituted aryl group, substituted or unsubstituted aralkyl group, substituted or unsubstituted alkoxy group, substituted or unsubstituted cycloalkyloxy group, substituted or unsubstituted alkenyloxy group, substituted or unsubstituted alkynyloxy group, substituted or unsubstituted aryloxy group, substituted or unsubstituted aralkyloxy group, substituted or unsubstituted alkylcarbonyloxy group, substituted or unsubstituted arylcarbonyloxy group, substituted or unsubstituted alkylcarbonyl group, substituted or unsubstituted arylcarbonyl group, substituted or unsubstituted carbamoyl group, substituted or unsubstituted amino group, halogen atom, nitro group, cyano group or hydroxyl group.

We conducted extensive research to overcome the foregoing drawbacks of conventional heat-sensitive recording materials for high-speed recording and found that the fading of record images and fogging of background portion are caused by the interaction between the color developing material of the heat-sensitive recording material and the plasticizer contained in the plastic film or the solvent component present in the developer of the diazo copying paper, particularly a mixture of ethylene glycol and its oligomers (e.g., diethylene glycol, triethylene glycol, etc.). We carried out investigations on a color developing material which would not be affected by such plasticizer or by the solvent component. Our investigations have revealed that the heat-sensitive recording materials prepared by using the foregoing multi-valent metal salt of an indole-2-carboxylic acid derivative of the formula (I) as the color developing material not only have high sensitivity and are suitable for use in high-speed recording but also have excellent resistance to the plasticizer and diazo developer. We have accomplished the present invention based on this novel finding.

The heat-sensitive recording materials of the present invention are rendered suited to high-speed recording due to the use of the multi-valent metal salt of the compound of the formula (I). Furthermore, the recording materials of the invention exhibit such high resistance to the plasticizer that they are substantially free from the fading of the record image even when stored as contacted with plastic film. They also exhibit such high resistance to the developer of diazo copying paper that they do not pose the problem of marked reduction in the whiteness of the background portion even when stored in contact with diazo copying paper immediately after copying operation.

It remains to be clarified why the multi-valent metal salt of the indole-2-carboxylic acid derivative of the formula (I) can make heat-sensitive recording materials suitable for high-speed recording and resistant to a plasticizer and diazo developer. One of the factors which improve the above properties of the recording materials is presumably that the multi-valent metal salts of the compounds of the formula (I) are sparingly soluble in the plasticizer or in the solvent component present in diazo developer.

Of the indole-2-carboxylic acid derivatives of the formula (I), those represented by the formula

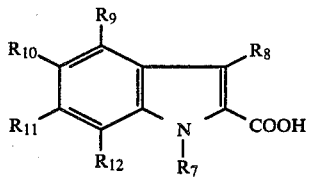

(II)

wherein $R_7$ represents:

hydrogen atom, $C_1$–$C_8$ alkyl group optionally having $C_1$–$C_4$ alkoxy group as the substituent, $C_5$–$C_{12}$ cycloalkyl group optionally having halogen atom or $C_1$–$C_4$ alkyl group as the substituent, allyl group optionally having $C_1$–$C_4$ alkyl group or phenyl group as the substituent, propargyl group optionally having $C_1$–$C_4$ alkyl group or phenyl group as the substituent, phenyl group optionally having halogen atom, $C_1$–$C_4$ alkyl group or $C_1$–$C_4$ alkoxy group as the substituent, phenyl-$C_1$–$C_3$ alkyl group optionally having halogen atom, $C_1$–$C_4$ alkyl group or $C_1$–$C_4$ alkoxy group as the substituent, $C_1$–$C_4$ alkylcarbonyl group, or benzoyl group optionally having halogen atom, $C_1$–$C_4$ alkyl group or $C_1$–$C_4$ alkoxy group as the substituent; and $R_8$ through $R_{12}$ each represent:

hydrogen atom, $C_1$–$C_8$ alkyl group optionally having $C_1$–$C_4$ alkoxy group or di($C_1$–$C_4$ alkyl)amino group as the substituent, allyl group optionally having $C_1$–$C_4$ alkyl group or phenyl group as the substituent, propargyl group optionally having $C_1$–$C_4$ alkyl group or phenyl group as the substituent, phenyl group optionally having halogen atom, hydroxyl group, $C_1$–$C_4$ alkyl group or $C_1$–$C_4$ alkoxy group as the substituent, phenyl-$C_1$–$C_3$ alkyl group optionally having halogen atom, $C_1$–$C_4$ alkyl group or $C_1$–$C_4$ alkoxy group as the substituent, $C_1$–$C_4$ alkoxy group optionally having phenyl group or phenoxy group as the substituent, allyloxy group optionally having $C_1$–$C_4$ alkyl group or phenyl group as the substituent, propargyloxy group optionally having $C_1$–$C_4$ alkyl group or phenyl group as the substituent, phenoxy group optionally having halogen atom, $C_1$–$C_4$ alkyl group or $C_1$–$C_4$ alkoxy group as the substituent, phenyl-$C_1$–$C_3$ alkyloxy group optionally having halogen atom, $C_1$–$C_4$ alkyl group or $C_1$–$C_4$ alkoxy group as the substituent, $C_1$–$C_4$ alkoxy group, benzoyloxy group optionally having halogen atom, $C_1$–$C_4$ alkyl group or $C_1$–$C_4$ alkoxy group as the substituent;

$C_1$–$C_4$ allyloxy group, benzoyl group optionally having halogen atom, $C_1$–$C_4$ alkyl group or $C_1$–$C_4$ alkoxy group as the substituent, carbamoyl group optionally having $C_1$–$C_4$ alkyl group or or phenyl group as the substituent, amino group optionally having benzoyl group, benzenesulfonyl group, $C_1$–$C_8$ alkyl group, phenyl group, benzyl group or $C_1$–$C_4$ alkylcarbonyl group wherein the benzoyl group or benzenesulfonyl group may optionally be substituted with halogen atom, $C_1$–$C_4$ alkyl group or $C_1$–$C_4$ alkoxy group, halogen atom, nitro group, cyano group or hydroxyl group.

Particularly, it is more preferable in the invention to use as the indole-2-carboxylic acid derivative a compound of the formula

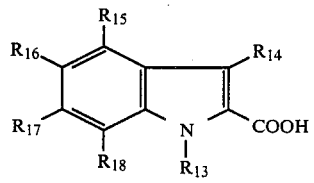

(III)

wherein $R_{13}$ is hydrogen atom or $C_1$–$C_4$ alkyl group, and $R_{14}$ through $R_{18}$ each represent hydrogen atom, $C_1$–$C_4$ alkyl group optionally having di($C_1$–$C_4$ alkyl)amino group as the substituent, phenyl group optionally having hydroxyl group as the substituent, $C_1$–$C_4$ alkoxy group, phenoxy group, benzyloxy group, $C_1$–$C_4$ alkylcarbonyloxy group, benzoyloxy group, $C_1$–$C_4$ alkylcarbonyl group, benzoyl group, halogen atom, cyano group or hydroxyl group.

The multi-valent metal salts of the indole-2carboxylic acid derivative of the foregoing formula (II) can afford heat-sensitive recording materials especially suitable for high-speed recording and excellent in resistance to the plasticizer and resistance to the diazo developer, and therefore are preferable. Of the multi-valent metal salts of the indole-2-carboxylic acid derivatives of the formula (II), those of the compounds represented by the formula (III) are also advantageous in that their preparation is commercially feasible, and therefore more preferable.

The multi-valent metals for forming the salts of the indole-2-carboxylic acid derivatives of the formula (I) may include various metals having a valency of 2 or more, preferably 2 or 3, and particularly include magnesium, calcium, barium, zinc, aluminum, tin, iron, cobalt, nickel, copper and the like, preferably magnesium, calcium, barium, zinc and aluminum. Of these metals, magnesium, calcium, barium, zinc, tin, iron, cobalt, nickel and copper are divalent and aluminum is trivalent. Iron can also be trivalent.

Specific examples of the multi-valent metal salts of the compound of the formula (I) are magnesium salts, calcium salts, barium salts, zinc salts, aluminum salts, tin salts, iron salts, cobalt salts, nickel salts, or copper salts of the following indole-2-carboxylic acid derivatives:

Indole-2-carboxylic acid, 1-methylindole-2-carboxylic acid, 3-methylindole-2-carboxylic acid, 5-methylindole-2-carboxylic acid, 6-methylindole-2carboxylic acid, 1,3-dimethylindole-2-carboxylic acid, 1,5-dimethylindole-2-carboxylic acid, 1-phenylindole-2-carboxylic acid, 3-phenylindole-2-carboxylic acid, 3-(2-hydroxyphenyl)indole-2-carboxylic acid, 1-benzylindole-2carboxylic acid, 1-allylindole-2-carboxylic acid, 1-propargylindole-2-carboxylic acid, 1-acetylindole-2-carboxylic acid, 3-acetylindole-2-carboxylic acid, 1-benzoylindole-2-carboxylic acid, 3-benzoylindole-2-carboxylic acid, 5-methoxyindole-2-carboxylic acid, 5-ethoxyindole-2-carboxylic acid, 5-phenoxyindole-2-carboxylic acid, 5-(benzyloxy)indole-2-carboxylic acid, 5-(cyclohexyloxy)indole-2-carboxylic acid, 5-acetoxyindole-2-carboxylic acid, 5-(benzoyloxy)indole-2-carboxylic acid, 5-carbamoylindole-2-carboxylic acid, 5-chloroindole-2carboxylic acid, 4-nitroindole-2-carboxylic acid, 5nitroindole-2-carboxylic acid, 5-cyanoindole-2-carboxylic acid, 5-hydroxyindole-2-carboxylic acid, 5-(dimethylamino)indole-2-carboxylic acid, 5-anilinoindole-2carboxylic acid, 1-(2-methoxyethyl)indole-2-carboxylic acid, 1-cyclohexylindole-2-carboxylic acid, 5,7-dimethylindole-2-carboxylic acid, 3-(N,N-dimethylaminomethyl)indole-2-carboxylic acid, 7-(2-methoxyethyl)indole-2carboxylic acid, 3-(2-ethoxyphenyl)indole-2-carboxylic acid, 3-(4-chlorophenyl)indole-2-carboxylic acid, 5-(2-phenoxyethoxy)indole-2-carboxylic acid, 5-isobutoxyindole-2-carboxylic acid, 5-allyloxyindole-2-carboxylic acid, 5-(4-chlorophenoxy)indole-2-carboxylic acid, 7-(p-chlorobenzyl)indole-2-carboxylic acid, 7-chloroindole-2carboxylic acid, 5,6-dimethoxyindole-2-carboxylic acid, 7-cyanoindole-2-carboxylic acid, 3-hydroxyindole-2carboxylic acid, 3-benzoylaminoindole-2-carboxylic acid, 3-acetylaminoindole-2-carboxylic acid, 3-p-toluenesulfonylaminoindole-2-carboxylic acid.

These compounds can be used singly or at least two of them are usable in admixture.

The multi-valent metal salts of the indole-2carboxylic acid derivative of the formula (I) can be prepared according to well-known methods, for example, by first synthesizing the indole-2-carboxylic acid derivative of the formula (I) by Fischer's indole synthesis (E. Fischer, O. Hess, Ber., 17, 559 (1883)), Madelung method (W. Madelung, Ber., 45, 3521 (1912)), Reissert method (A. Reissert, Ber., 41, 3925 (1908)) and the like, and then subjecting the resulting indole-2-carboxylic acid derivative to a salt-forming reaction in a conventional manner.

Examples of useful colorless or pale-colored basic dyes which can be used to form the heat-sensitive record layer for the present heat-sensitive recording materials include those heretofore known as given below.

Triarylmethane-based dyes, e.g. 3,3-bis(p-dimethylaminophenyl)-6-dimethylaminophthalide, 3,3-bis(p-dimethylaminophenyl)phthalide, 3-(p-dimethylaminophenyl)3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylaminophthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenylspiro-dinaphthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-ethyl-N-isoaml-)amino-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-pyrrolidino-6methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-6-methyl-7-p-butylphenylaminofluoran, 3-N-methyl-N-n-amyl)amino-6-methyl-7-phenylaminofluoran, 3-(N-ethyl-N-n-amyl)amino-6-methyl-7-phenylaminofluoran, 3-(N-methyl-N-n-hexyl-)amino-6methyl-7-pehnylaminofluoran, 3-(N-ethyl-N-n-hexyl)amino-6-methyl-7-penylaminofluoran, 3-(N-ethyl-N-$\beta$-ethylhexyl)amino-6-methyl-7-phenylaminofluoran, etc.

Fluorene-based dyes, e.g., 3,6-bis(dimethylamino)-fluorene-9-spiro-3'-(6'-dimethylamino)phthalide, 3-dimethylamino-6-(N-methyl-N-allylamino)fluorene-9-spiro-3'-(6'-dimethylamino)phthalide, etc.

The basic dyes useful in this invention are not limited to those exemplified above, and at least two of them can be used in admixture.

There is no specific restriction on the ratio of the basic dye and the color developing material i.e., the multi-valent metal salt of the compound of the formula (I) having the above-specified structure. Generally about 50 to about 500 parts, preferably about 100 to about 400 parts, by weight of the color developing material is used per 100 parts by weight of the basic dye.

These materials are formulated into a coating composition for a heat-sensitive record layer generally with use of water as a dispersion medium and with use of a stirring or pulverizing device such as a ball mill, attritor or sand mill, by dispersing the materials at the same time or separately.

Usually the coating composition has incorporated therein a binder such as starches, hydroxyethyl cellulose, methyl cellulose, carboxymethyl cellulose, gelatin, casein, gumarabic, polyvinyl alcohol, styrene-maleic anhydride copolymer salt, styrene-acrylic acid copolymer salt, styrene-butadiene copolymer emulsion and the like. The amount of the binder used is about pb 10 to about 40% by weight, preferably about 15 to about 3% by weight, based on the weight of the total solids content of the composition.

Various auxiliary agents can be included in the coating composition. Examples of useful auxiliary agents are dispersants such as sodium dioctylsulfosuccinate, sodium dodecylbenzenesulfonate, sodium lauryl sufate and fatty acid metallic salts, ultra-violet absorbers of the triazole or other type, defoaming agents, fluorescent dyes, coloring dyes, etc. A dispersion or emulsion of stearic acid, polyethylene, carnauba wax, paraffin wax, zinc stearate, calcium stearate, ester wax or the like can be incorporated in the coating composition in order to prevent the heat-sensitive recording material from sticking to the recording machine or thermal recording head on its contact therewith.

Insofar as the desired results of the present invention are not impaired, other additives can be contained in the coating composition. Examples of the additives are various known thermally fusible materials, e.g., fatty acid amides such as stearic acid amide. stearic acid methylenebisamide, oleic acid amide, palmitic acid amide and coconut fatty acid amide, hindered phenols such as 2,2'-methylene-bis(4-methyl-6-tert-butylphenol) and 1,1,3-tris(2-methyl-4-hydroxy-5-tert-butylphenyl)butane, ethers such as 1,2-bis(phenoxy)ethane, 1,2-bis(4-methylphenoxy)ethane, 1,2-bis(3-methylphenoxy)ethane and napthalene-2 benzyl ether, esters sucah as dibenzyl terepththalate and phenyl ester of 1-hydroxy-2-napthoic acid, etc. The amount of these thermally fusible material, when used, is not particularly limited, but is preferably about 100 to about 500 parts by weight per 100 parts by weight of the basic dye.

An inorganic pigment such as kaolin, clay, talc, calcium carbonate, calcined clay, titanium oxide, diatomaceous earth, fine granular anhydrous silica, activated clay and the like can be added to the coating composition in order to eliminated or reduce the tendency for the residue to be piled on the thermal recording head.

Although the present invention has an important feature of using the specific metal salt of an indole-2-carboxylic acid derivative of the formula (I) as the color developing material, the coating composition can incorporate conventional phenol-type color developong materials such as 4,4'-cyclohexylidene diphenol (bisphenol A), 4,4'-cyclohexylidene diphenol, benzyl p-hydroxybenzoate, dimethyl 4-hydroxyphthalate, 4-hydroxy-4'-isopropoxydiphenyl sulfone, etc., insorfar as these conventional color developing materials do not deteriorate the results contemplated by this invention.

Base sheets which can be used for the present heat-sensitive recording materials include paper, plastics film, synthetic fiber sheet, etc. among which paper is most preferred in terms of costs, adequacy fo coating, etc. The amount of the coating composition to be applied to the base sheet to form a record layer thereon is not particularly limited, but is generally about 2 to about 12 g/m$^2$, preferably about 3 to about 10 g/m$^2$, based on the dry weidght. Furthermore, and overcoat can be formed over the record layer to protect the later. It is also possible to apply a protective coat to the rear side of the base sheet or to apply an undercoat between the record layer and the base sheet. Various other technologies known in the art area applicable to thye present invention.

The heat-sensitive recording materials thus prepared are s uitable for high-speed recording, eliminate the tendency to face the images and to fog the background portion and involve lesser amounts of residue piled on the thermal recording head.

The present invention will be described below in more detail with reference to examples to which, however, this invention is in no way limited. In the examples and comparative examples that follow, the parts and percentages are all by weight unless otherwise specified.

EXAMPLE 1

(1) Preparation of mixture A

| | |
|---|---|
| 3-(N—Cyclohexyl-N—methylamino)-6-methyl-7-phenylaminofluoran | 10 parts |
| Stearic acid amide | 20 parts |
| 5% Aqueous solution of methyl cellulose | 15 parts |
| Water | 120 parts |

The above mixture was pulverized by a sand mill to a mean particle size of 3 μm.

(2) Preparation of mixture B

| | |
|---|---|
| Zinc salt of indole-2-carboxylic acid | 30 parts |
| 5% Aqueous solution of methyl cellulose | 30 parts |
| Water | 70 parts |

The above mixture was pulverized by a sand mill to a mean particle size of 3 μm.

(3) Formation of record layer

One hundred and sixty-five parts of the mixture A, 130 parts of the mixture B, 30 parts of silicon oxide pigment (oil absorption 180 ml/100 g), 150 parts of a 20% aqueous solution of oxidized starch and 55 parts of water were mixed together and agitated to obtain a coating composition. The composition was applied to non-coated paper weighting 50 g/m$^2$ in an amount pf 7.5 g/m$^2$ based on dry weight, and dried to give a heat-sensitive recording paper.

EXAMPLES 2–19

Eighteen kinds of heat-sensitive recording papers were prepared in the same manner as in Example 1 except that the multi-valent metal salts of the indole-2-carboxylic acid derivatives listed in Table 1 below ere used in place of the zinc salt of indole-2-carboxylic acid used for preparing the mixture B.

COMPARATIVE EXAMPLES 1 and 2

Two kinds of heat-sensitive recording papers were prepared in the same manner as in Example 1 except that the compounds listed in Table 1 below were used in place of the zinc salt of indole-2-carboxylic acid used for the preparation of the mixture B.

The 21 kinds of the heat-sensitive recording papers prepared above were caused to form images thereon with use of a thermal facsimile (Model HIFAX-700, product of Hitachi, Ltd., Japan), and the color density ($D_0$) of the record image was measured by a Macbeth reflection densitometer (Model RD-100R, product of Macbeth Corp., U.S. using amber filer). Table 1 below shows the results.

Then, the heat-sensitive recording materials after recording were superposed on a vinyl chloride film so that the recorded portion was kept in contact with the film. After 5 hours, the color density ($D_1$)of the record image was measured by the same reflection densitometer. Table 1 below shows the results.

The whiteness of the record layer of the heat-sensitive recording materials before recording was determined buy a Hunter multipurpose reflectometer (product of Toyo Seiki Seisakusho, Japan) and then a sheet of non-coated paper impregnated with a diazo developer (SD type, product of Ricoh Co., Ltd., Japan) was superposed on the heat-sensitive recording materials. After they were left to stand in this state for 5 minutes, the whiteness of the record layer was measured in the same manner as above with the results as indicated below in Table 1.

TABLE 1

| | Color developing material | Color density ($D_0$) | Color density after test for plasticizer resistance ($D_1$) | Whiteness before recording (%) | Whiteness after test for diazo resistance (%) |
|---|---|---|---|---|---|
| Ex. | | | | | |
| 1 | Zinc salt of indole-2-carboxylic acid | 1.31 | 1.27 | 84.1 | 82.9 |
| 2 | Calcium salt of indole-2-carboxylic acid | 1.29 | 1.24 | 84.8 | 83.2 |
| 3 | Zinc salt of 1-methylindole-2-carboxylic acid | 1.33 | 1.25 | 84.4 | 83.3 |
| 4 | Zinc salt of 3-phenylindole-2-carboxylic acid | 1.32 | 1.24 | 84.2 | 83.0 |
| 5 | Zinc salt of 5-methoxyindole-2-carboxylic acid | 1.34 | 1.20 | 83.1 | 82.7 |
| 6 | Zinc salt of 5-chloroindole-2-carboxylic acid | 1.30 | 1.26 | 84.3 | 83.9 |
| 7 | Aluminum salt of 3-(2-hydroxyphenyl)indole-2-carboxylic acid | 1.33 | 1.30 | 83.9 | 81.7 |
| 8 | Zinc salt of 5-benzyloxyindole-2-carboxylic acid | 1.31 | 1.24 | 84.6 | 84.0 |
| 9 | Barium salt of 7-chloroindole-2-carboxylic acid | 1.29 | 1.20 | 84.2 | 82.8 |
| 10 | Zinc salt of 5,6-dimethoxyindole-2-carboxylic acid | 1.32 | 1.21 | 83.5 | 82.3 |
| 11 | Calcium salt of 5-hydroxyindole-2-carboxylic acid | 1.28 | 1.19 | 84.5 | 82.1 |
| 12 | Zinc salt of 3-hydroxyindole-2-carboxylic acid | 1.31 | 1.28 | 83.9 | 82.8 |
| 13 | Calcium salt of 5-phenoxyindole-2-carboxylic acid | 1.27 | 1.20 | 84.4 | 83.5 |
| 14 | Zinc salt of 7-cyanoindole-2-carboxylic acid | 1.31 | 1.26 | 84.0 | 82.7 |
| 15 | Magnesium salt of 5-acetoxyindole-2-carboxylic acid | 1.30 | 1.19 | 83.8 | 82.0 |
| 16 | Zinc salt of 5,7-dimethylindole-2-carboxylic acid | 1.33 | 1.24 | 84.0 | 82.9 |
| 17 | Zinc salt of 3-acetylindole-2-carboxylic acid | 1.33 | 1.22 | 84.3 | 83.3 |
| 18 | Calcium salt of 3-benzoylindole-2-carboxylic acid | 1.27 | 1.20 | 84.6 | 83.9 |
| 19 | Zinc salt of 3-(N,N—dimethylaminomethyl)indole-2-carboxylic acid | 1.34 | 1.17 | 83.6 | 81.8 |
| Comp. Ex. | | | | | |
| 1 | Bisphenol A | 1.27 | 0.21 | 80.4 | 52.1 |
| 2 | Zinc salicylate | 1.29 | 1.07 | 52.0 | 49.8 |

As seen from Table 1, the heat-sensitive recording papers of the present invention can produce images of high color density, thus have a high sensitivity and are suitable for high-speed recording, and are excellent in resistances to plasticizer and diazo developer, and therefore have high retentivity of the record image and whiteness of the background portion.

We claim:

1. A heat-sensitive recording material comprising a base sheet and a heat-sensitive record layer formed over the base sheet and comprising a colorless or pale-colored basic dye and a color developing material capable of forming a color when contacted with the dye, the heat-sensitive recording material being characterized in that the heat-sensitive record layer contains as the color developing material at least one multi-valent metal salt of an indole-2-carboxylic acid derivative represented by the formula

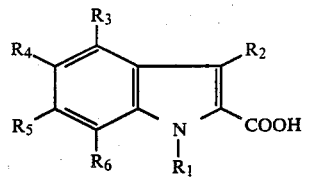

(I)

wherein $R_1$ is hydrogen atom, substituted or unsubstituted alkyl group, substituted or unsubstituted cycloalkyl group, substituted or unsubstituted alkenyl group, substituted or unsubstituted alkynyl group, substituted or unsubstituted aryl group, substituted or unsubstituted aralkyl group, substituted or unsubstituted alkylcarbonyl group or substituted or unsubstituted arylcarbonyl group; and $R_2$ through $R_6$ each represent hydrogen atom, substituted or unsubstituted alkyl group, substituted or unsubstituted cycloalkyl group, substituted or unsubstituted alkenyl group, substituted or unsubstituted alkynyl group, substituted or unsubstituted aryl group, substituted or unsubstituted aralkyl group, substituted or unsubstituted alkoxy group, substituted or unsubstituted cycloalkyloxy group, substituted or unsubstituted alkenyloxy group, substituted or unsubstituted alkynyloxy group, substituted or unsubstituted aryloxy group, substituted or unsubstituted aralkyloxy group, substituted or unsubstituted alkylcarbonyloxy group, substituted or unsubstituted arylcarbonyloxy group, substituted or unsubstituted alkylcarbonyl group, substituted or unsubstituted arylcarbonyl group, substituted or unsubstituted carbamoyl group, substituted or unsubstituted amino group, halogen atom, nitro group, cyano group or hydroxyl group.

2. A heat-sensitive recording material as defined in claim 1 wherein the indole-2-carboxylic acid derivative is represented by the formula

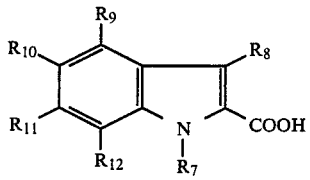

(II)

wherein $R_7$ represents:

hydrogen atom, $C_1$–$C_8$ alkyl group optionally having $C_1$–$C_4$ alkoxy group as the substituent, $C_5$–$C_{12}$ cycloalkyl group optionally having halogen atom or $C_1$–$C_4$ alkyl group as the substituent, allyl group optionally having $C_1$–$C_4$ alkyl group or phenyl group as the substituent, propargyl group optionally having $C_1$–$C_4$ alkyl group or phenyl group as the substituent, phenyl group optionally having halogen atom, $C_1$–$C_4$ alkyl group or $C_1$–$C_4$ alkoxy group as the substituent, phenyl-$C_{1p}$–$C_3$ alkyl group optionally having halogen atom, $C_1$–$C_4$ alkyl group or $C_1$–$C_4$ alkoxy group as the substituent, $C_1$–$C_4$ alkylcarbonyl group, or benzoyl group optionally having halogen atom, $C_1$–$C_4$ alkyl group or $C_1$–$C_4$ alkoxy group as the substituent; and $R_8$ through $R_{12}$ each represent:

hydrogen atom, $C_1$–$C_8$ alkyl group optionally having $C_1$–$C_4$ alkoxy group or di($C_1$–$C_4$ alkyl)amino group as the substituent, allyl group optionally having $C_1$–$C_4$ alkyl group or phenyl group as the substituent, propargyl group optionally having $C_1$–$C_4$ alkyl group or phenyl group as the substituent, phenyl group optionally having halogen atom, hydroxyl group, $C_1$–$C_4$ alkyl group or $C_1$–$C_4$ alkoxy group as the substituent, phenyl-$C_1$–$C_3$ alkyl group optionally having halogen atom, $C_1$–$C_4$ alkyl group or $C_1$–$C_4$ alkoxy group as the substituent, $C_1$–$C_4$ alkoxy group optionally having phenyl group or phenoxy group as the substituent, allyloxy group optionally having $C_1$–$C_4$ alkyl group or phenyl group as the substituent, propargyloxy group optionally having $C_1$–$C_4$ alkyl group or phenyl group as the substituent, phenoxy group optionally having halogen atom, $C_1$–$C_4$ alkyl group or $C_1$–$C_4$ alkoxy group as the substituent, phenyl-$C_1$–$C_3$ alkyloxy group optionally having halogen atom, $C_1$–$C_4$ alkyl group or $C_1$–$C_4$ alkoxy group as the substituent, $C_1$–$C_4$ alkylcarbonyloxy group, benzoyloxy group optionally having halogen atom, $C_1$–$C_4$ alkyl group or $C_1$–$C_4$ alkoxy group as the substituent, carbamoyl group optionally having $C_1$–$C_4$ alkyl group or phenyl group as the substituent, amino group optionally having benzoyl group, benzeneasulfonyl group, $C_1$–$C_8$ alkyl group, phenyl group, benzyl group or $C_1$–$C_4$ alkylcarbonyl group whrein the benzoyl group or benzenesulfonyl group may optionally be substitutedd with halogen atom, $C_1$–$C_4$ alkyl group or $C_1$–$C_4$ alkoxy group, halogen atom, nitro group, cyano group or hydroxyl group.

3. A heat-sensitive recording material as defined in claim 1 wherein the indole-2-carboxylic acid derivative is represented by the formula

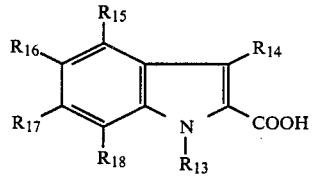

(III)

wherein $R_{13}$ is hydrogen atom or $C_1$–$C_4$ alkyl group, and $R_{14}$ through $R_{18}$ each represent hydrogen atom, $C_1$–$C_4$ alkyl group optionally having di($C_1$–$C_4$ alkyl-)amino group as the substituent, phenyl group optionally having hydroxyl group as the substituent, $C_1$–$C_4$ alkoxy group, phenoxy group, benzyloxy group, $C_1$–$C_4$ alkylcarbonyloxy group, benzoyloxy group, $C_1$–$C_4$ alkylcarbonyl group, benzoyl group, halogen atom, cyano group or hydroxyl group.

4. A heat-sensitive recording material as defined in claim 1 wherein the multi-valent metal salt is magnesium salt, calcium salt, barium, salt, zinc salt, aluminum salt, tin salt, iron salt, cobalt salt, nickel salt or copper salt.

5. A heat-sensitive recording material as defined in claim 1 wherein the multi-valent metal salt is magnesium salt, calcium salt, barium salt, zinc salt or aluminum salt.

6. A heat-sensitive recording material as defined in claim 1 wherein the multi-valent metal salt of indole-2-carboxylic acid derivative is a zinc, magnesium, calcium, barium or aluminum salt of an indole-2-carboxylic acid derivative of the formula

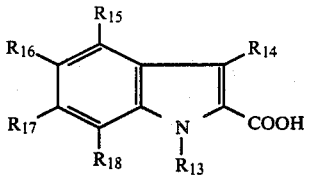

(III)

wherein $R_{13}$ is hydrogen atom or $C_1$–$C_4$ alkyl group, and $R_{14}$ through $R_{18}$ each represent hydrogen atom, $C_1$–$C_4$ alkyl group optionally having di($C_1$–$C_4$ alkyl-)amino group as the substituent, phenyl group optionally having hydroxyl group as the substituent, $C_1$–$C_4$ alkoxy group, phenoxy group, benzyloxy group, $C_1$–$C_4$ alkylcarbonyloxy group, benzyloxy group, $C_1$–$C_4$ alkylcarbonyl group, benzoyl group, halogen atom, cyano group or hydroxyl group.

* * * * *